US008246045B2

(12) United States Patent
Kubo

(10) Patent No.: US 8,246,045 B2
(45) Date of Patent: Aug. 21, 2012

(54) SHEET FEEDING APPARATUS AND IMAGE FORMING APPARATUS

(75) Inventor: Shinji Kubo, Susono (JP)

(73) Assignee: Canon Kabushiki Kaisha (JP)

( * ) Notice: Subject to any disclaimer, the term of this patent is extended or adjusted under 35 U.S.C. 154(b) by 287 days.

(21) Appl. No.: 12/473,911

(22) Filed: May 28, 2009

(65) Prior Publication Data

US 2009/0295068 A1 Dec. 3, 2009

(30) Foreign Application Priority Data

May 29, 2008 (JP) ..... 2008-140491

(51) Int. Cl.
*B65H 1/04* (2006.01)

(52) U.S. Cl. ..... 271/171; 271/145

(58) Field of Classification Search ..... 271/233, 271/253, 171, 145, 241
See application file for complete search history.

(56) References Cited

U.S. PATENT DOCUMENTS

| | | | | |
|---|---|---|---|---|
| 4,949,134 | A * | 8/1990 | Iwaki et al. | 399/402 |
| 5,611,528 | A * | 3/1997 | Nakamura et al. | 271/164 |
| 5,931,456 | A * | 8/1999 | Laidlaw | 271/171 |
| 7,004,462 | B2 * | 2/2006 | Bryer | 271/171 |
| 7,527,259 | B2 * | 5/2009 | Meetze et al. | 271/171 |
| 7,694,958 | B2 * | 4/2010 | Nakamura | 271/171 |
| 7,694,959 | B2 * | 4/2010 | Shimazu et al. | 271/171 |
| 7,703,763 | B2 * | 4/2010 | Shiohara et al. | 271/145 |
| 7,824,116 | B2 * | 11/2010 | Lyman | 400/613 |
| 7,922,171 | B2 * | 4/2011 | Kawamura et al. | 271/171 |
| 2004/0135306 | A1 * | 7/2004 | Takahashi | 271/145 |
| 2008/0001346 | A1 * | 1/2008 | Meetze et al. | 271/171 |
| 2008/0079214 | A1 * | 4/2008 | Kawarago | 271/18 |

FOREIGN PATENT DOCUMENTS

| | | | |
|---|---|---|---|
| JP | 2001097561 | A * | 4/2001 |
| JP | 2001310824 | A * | 11/2001 |
| JP | 2003212359 | A * | 7/2003 |
| JP | 2004123292 | A * | 4/2004 |
| JP | 2004196504 | A * | 7/2004 |
| JP | 2004315159 | A * | 11/2004 |
| JP | 2005041646 | A * | 2/2005 |
| JP | 2006151656 | A * | 6/2006 |
| JP | 2007001706 | A * | 1/2007 |
| JP | 2007-197159 | A | 8/2007 |
| JP | 2007217160 | A * | 8/2007 |
| JP | 2007223686 | A * | 9/2007 |
| JP | 2008063143 | A * | 3/2008 |

* cited by examiner

*Primary Examiner* — Michael McCullough
*Assistant Examiner* — Howard Sanders
(74) *Attorney, Agent, or Firm* — Rossi, Kimms & McDowell LLP

(57) ABSTRACT

A holding mechanism which holds a rear end restricting plate at the restricting position in accordance with the sheet size is configured with a first rack tooth row and a second rack tooth row. The first rack tooth row and the second rack tooth row are arranged at the bottom surface of a cassette body to be the same height along the sheet restricting direction and a first tooth row and a second tooth row are arranged at a restricting member to be the same height along the sheet restricting direction.

10 Claims, 12 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus. More particularly, the invention relates to a configuration positioning of a restricting member which is movably arranged at a sheet cassette to restrict a sheet position.

2. Description of the Related Art

Recently, a configuration in which a sheet is fed to an image forming portion for forming an image has been widely employed for an image forming apparatus such as a printer and a copying machine. It is common that such an image forming apparatus has a sheet feeding apparatus which automatically feeds a sheet accommodated in a sheet cassette to an image forming portion by a sheet feeding member while the sheet cassette is mounted to be detachably attachable to a body of the image forming apparatus.

A universal cassette capable of accommodating sheets of a variety of sizes within the same cassette is employed as the sheet cassette for such an image forming apparatus. Here, at a sheet accommodating portion of the universal cassette, a rear end restricting member which restricts the position of the rear end of the sheet accommodated in the sheet accommodating portion in the sheet feeding direction is disposed in order to accommodate sheets of different sizes. In addition, a side end restricting member which restricts the position in the direction perpendicular to the sheet feeding direction (hereinafter, called the width direction) is disposed.

With the universal cassette, the rear end of the sheet is restricted by the rear end restricting member while the side end is restricted by the side end restricting member. Thus, the top end of the sheet is always set at a predetermined position. In this manner, stable feeding of the sheet is performed regardless of the sheet size.

By the way, when the universal cassette is detached from and attached to the image forming apparatus body, for example, there is a case that these restricting members are moved by inertial force or impact of the sheet generated by the detaching and attaching operation. Then, when the restricting member is moved as mentioned above, the sheet may not be restricted at the appropriate restricting position. Consequently, it may cause problems such as poor feeding, skew feeding and double feeding during the sheet feeding operation.

In order to prevent the movement of the restricting member by the inertial force or the impact, a fixing mechanism to fix the restricting member is disposed to a conventional universal cassette. The mechanism disclosed in Japanese Patent Application Laid-open No. 2007-197159 is the fixing mechanism which firmly fixes the restricting member.

In this mechanism, two rows of rack teeth which are configured with a plurality of triangular teeth are arranged stepwise at the bottom surface of the cassette. Then, two rows of teeth which are configured with a plurality of triangular teeth to be engaged respectively with the stepwise arranged rack tooth rows are disposed at the restricting member which is movable frontward and backward. Further, the frontward movement of the restricting member is restricted by one tooth row of the restricting member being engaged with one rack tooth row of the cassette. The backward movement of the restricting member is restricted by the other tooth row of the restricting member being engaged with the other rack tooth row of the cassette. Accordingly, the restricting member is firmly fixed due to the engagement of both the tooth rows of the restricting member with both the rack tooth rows of the cassette.

The two tooth rows which are disposed at the restricting member are arranged at a holding portion which is supported being free to turn. By turning the holding portion, the two tooth rows of the restricting member are simultaneously released from the two rack tooth rows.

In the case that the two rack tooth rows and the two tooth rows are respectively arranged stepwise, the height of the cassette body becomes high due to the height necessary for accommodating the above-mentioned configuration. As a result, the universal cassette is upsized and the cost thereof is increased. Further, the image forming apparatus to which the cassette is mounted is upsized.

The present invention has been made in view of these circumstances, and an object thereof is to provide a sheet feeding apparatus and an image forming apparatus which can reliably hold a restricting member at a restricting position without upsizing a sheet cassette.

SUMMARY OF THE INVENTION

The present invention provides a sheet feeding apparatus which includes a sheet cassette having a restricting member which is movably disposed at a cassette body for accommodating sheets and restricts a position of the sheets by being moved to a position in accordance with the sheets, and a sheet feeding member which feeds the sheet from the sheet cassette. The sheet cassette includes a first engaged portion and a second engaged portion which are disposed at the cassette body, a first engaging member which is disposed at the restricting member and which restricts a movement of the restricting member by being engaged with the first engaged portion when a force is exerted to the restricting member in the sheet restricting direction for restricting the sheet, and a second engaging member which is disposed at the restricting member and which restricts a movement of the restricting member by being engaged with the second engaged portion when a force is exerted to the restricting member in the direction opposite to the sheet restricting direction. The first engaged portion and the second engaged portion are arranged at the bottom surface of the cassette body to be the same height along the sheet restricting direction and the first engaging member and the second engaging member are arranged at the restricting member to be the same height along the sheet restricting direction.

With the present invention, by disposing the first engaged portion and the second engaged portion in parallel at the bottom surface of the cassette body and disposing the first engaging member and the second engaging member in parallel at the restricting member, the restricting member can be reliably held at the restricting position without upsizing the sheet cassette.

Further features of the present invention will become apparent from the following description of exemplary embodiments (with reference to the attached drawings).

DESCRIPTION OF THE EMBODIMENTS

In the following, an exemplary embodiment of the present invention is described in detail with reference to the drawings.

Figure 1:
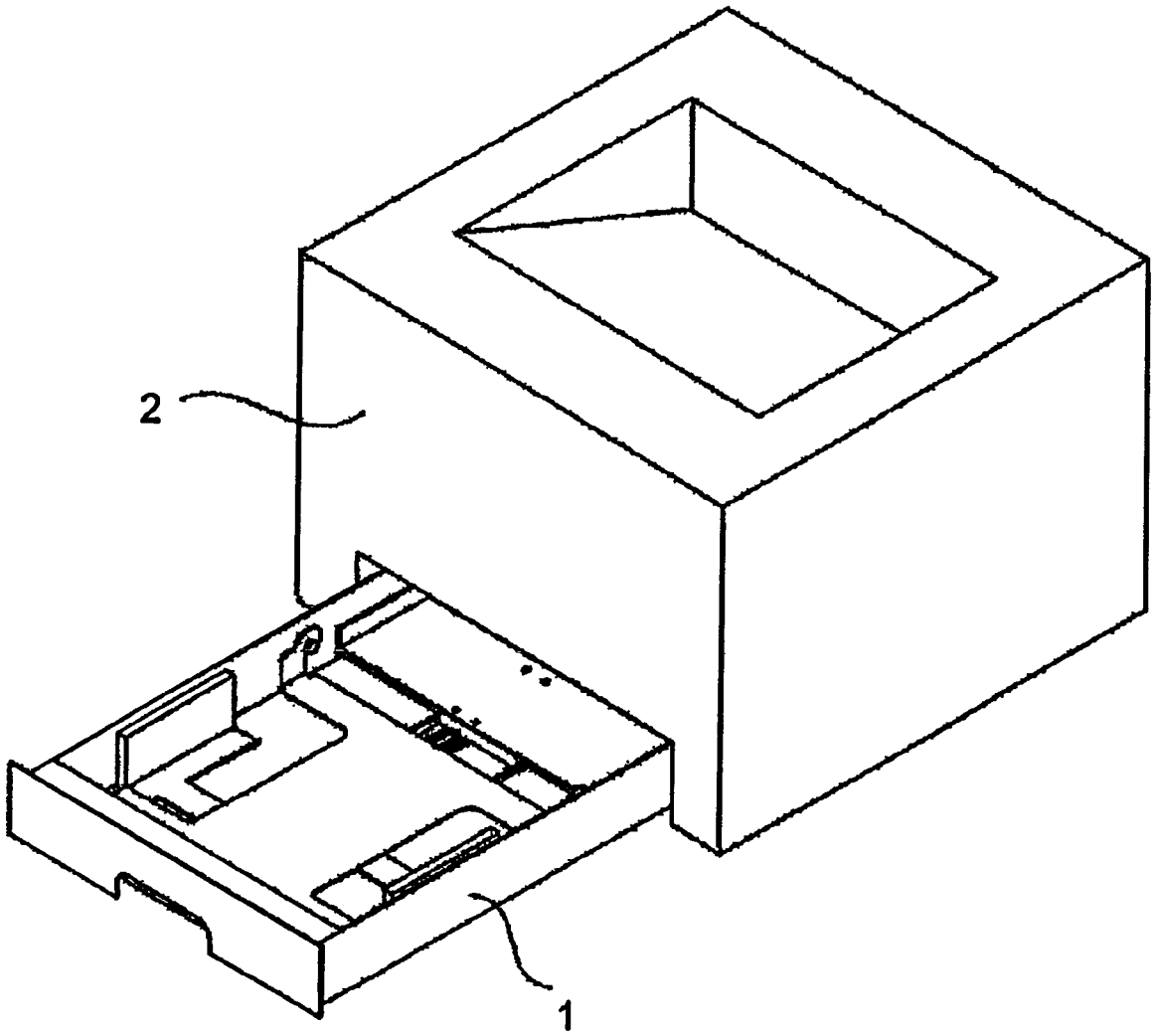
FIG. 1 is a perspective view of an image forming apparatus with a sheet feeding apparatus according to the first embodiment of the present invention.

FIG. 1 is a perspective view of an image forming apparatus with a sheet feeding apparatus according to the first embodiment of the present invention.

In FIG. 1, a universal cassette 1 is an example of a sheet cassette in which sheets are stacked and accommodated. The universal cassette 1 is configured to be detachably attachable to an image forming apparatus body 2.

Figure 2:
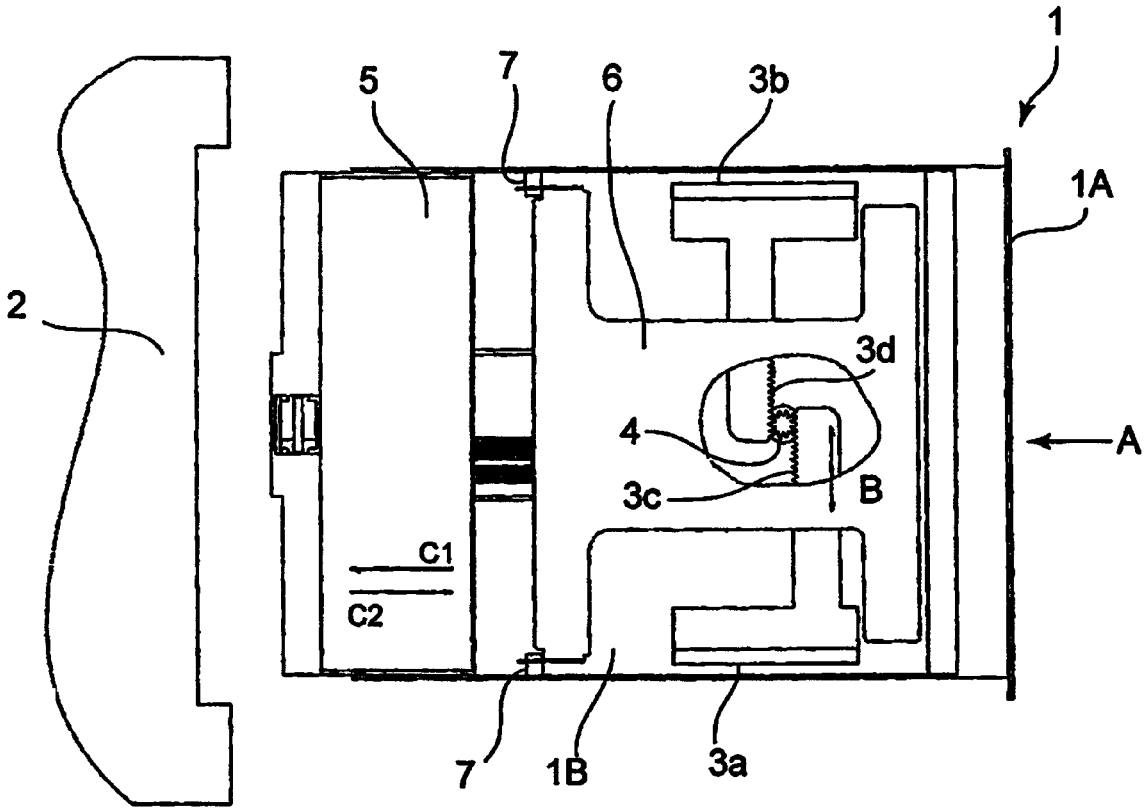
FIG. 2 is a schematic plane view of a universal cassette which is arranged at the sheet feeding apparatus.

FIG. 2 is a schematic plane view of the universal cassette 1 according to the present embodiment. The universal cassette 1 includes a cassette body 1A in which sheets of each size are stacked and accommodated, a pair of width restricting plates 3*a*, 3*b* as an example of the restricting member which restricts the side end position of the sheets, and a rear end restricting plate 5 as an example of the restricting member which restricts the rear end position of the sheets.

Further, the universal cassette 1 includes a middle plate 6 which is turned around a spindle 7 while being urged upward by an elastic member (not illustrated in the figures) and which presses the stacked sheets toward a sheet feeding roller as a sheet feeding member (not illustrated in the figures). Here, the width restricting plates 3*a*, 3*b* and the rear end restricting plate 5 are located so as not to affect the turning operation of the middle plate 6.

When the sheets of each size are accommodated into the cassette body 1A of the universal cassette 1, the side end position of the sheets is restricted by the width restricting plates 3*a*, 3*b* abutting the side end of the sheets and the rear end position of the sheets is restricted by the rear end restricting plate 5 abutting the rear end of the sheets.

In this manner, the sheets can be accommodated in a state of being positioned.

Here, when feeding the sheets, the middle plate 6 is turned upward around the spindle 7 by a turning mechanism (not illustrated in the figures) after the universal cassette 1 is attached to the image forming apparatus body from direction A. Accordingly, the sheets which are positioned by the width restricting plate 3*a*, 3*b* and the rear end restricting plate 5 are pressed to the sheet feeding roller.

The sheets which are pressed to the sheet feeding roller are fed one by one by the feeding operation of the sheet feeding roller and conveyed to an image forming portion which is disposed in the image forming apparatus body 2.

In the present embodiment, direction A which is the attaching direction of the universal cassette 1 is the same as the sheet feeding direction.

Here, the pair of width restricting plates 3*a*, 3*b* respectively have rack portions 3*c*, 3*d* at the lower parts thereof extending in direction B being the same as the width direction which is the movement direction of the width restricting plates 3*a*, 3*b*. The rack portions 3*c*, 3*d* are guided by guide grooves (not illustrated in the figures) which are arranged at the bottom surface 1B of the cassette body 1A in direction B so as to be movable in the width direction.

A pinion 4 is disposed at the center of the bottom surface of the cassette body 1A being free to turn. Rack teeth which are respectively formed at the rack portions 3*c*, 3*d* are engaged with the pinion 4. Accordingly, when one width restricting plate is moved in the width direction, the other width restricting plate is interlocked in the opposite direction by the operation of the pinion 4 and the rack portions 3*c*, 3*d*.

In this manner, by moving one width restricting plate, both the width restricting plates 3*a*, 3*b* are simultaneously moved in the width direction so as to abut the side ends of the sheets stacked on the middle plate 6. Therefore, positioning of the sheets in the width direction can be easily performed.

Next, the configuration of the rear end restricting plate 5 which restricts the rear end position of the sheets accommodated in the cassette body 1A and the holding mechanism which holds the rear end restricting plate 5 at the restricting position in accordance with the sheet size are described.

Figure 3:
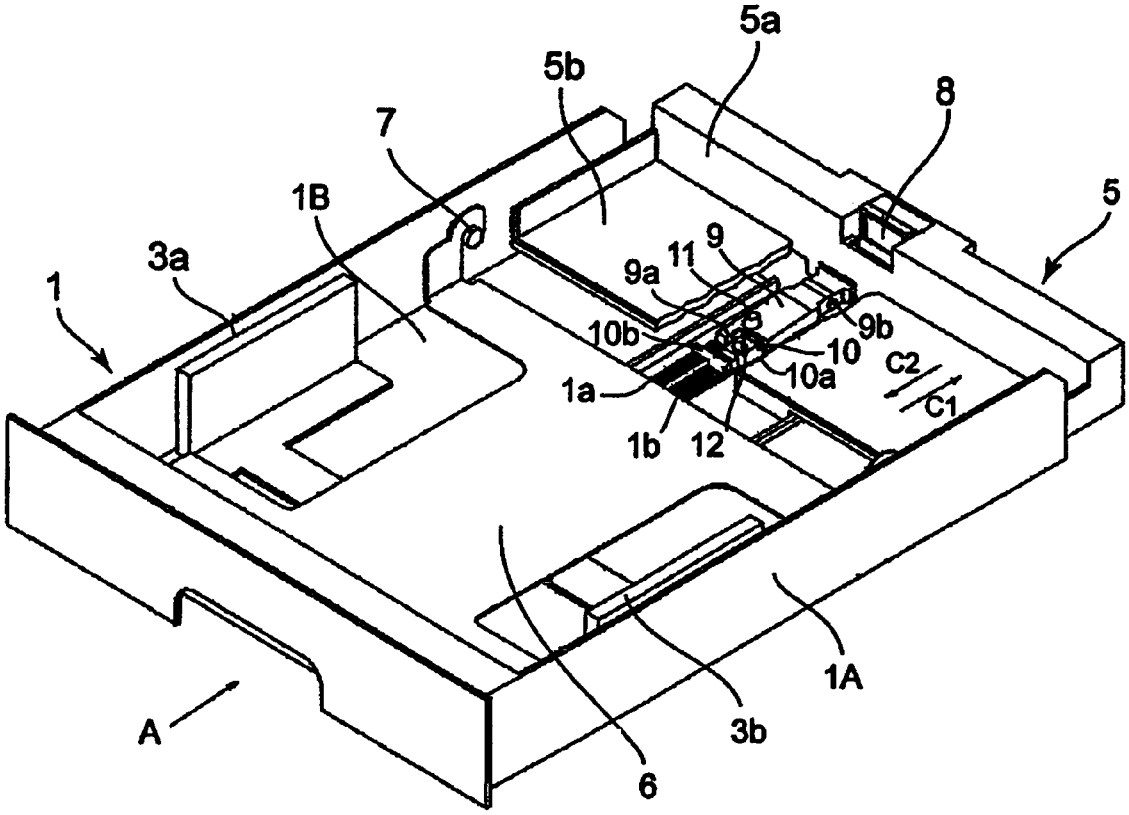
FIG. 3 is a perspective view which illustrates the configuration of the universal cassette.

The rear end restricting plate 5 is movable in the sheet feeding direction by being guided by a guide groove (not illustrated in the figures) which is arranged in directions C1, C2 at the bottom surface 1B of the cassette body 1A. Further, as illustrated in FIG. 3, the rear end restricting plate 5 includes a body portion 5*a* which abuts the rear end of the sheets, a slide portion 5*b* to which the body portion 5*a* is arranged being perpendicular thereto, and an operation lever 8 which is the operation portion to operate the rear end restricting plate 5.

Further, the rear end restricting plate 5 includes a first lock lever 9 as a first engaging member which holds the rear end restricting plate 5 at the restricting position being engaged with the bottom surface 1B of the cassette body 1A and a second lock lever 10 as a second engaging member which is arranged at the downstream side at the first lock lever 9 in the sheet feeding direction. Here, in the present embodiment, a holding portion which holds the rear end restricting plate 5 to the cassette body 1A at the restricting position in accordance with the sheet size is configured with the first lock lever 9 and the second lock lever 10 which are disposed to the rear end restricting plate 5.

The first lock lever 9 has a first tooth row 9*a* which is configured with a plurality of triangular teeth. The second lock lever 10 has a second tooth row 10*a* which is configured with a plurality of triangular teeth. The first tooth row 9*a* and the second tooth row 10*a* are arranged at the bottom surface 1B of the cassette body 1A so as to respectively correspond to a first rack tooth row 1*a* and a second rack tooth row 1*b* which are a first engaged portion and a second engaged portion configured with triangular teeth.

Figure 4:
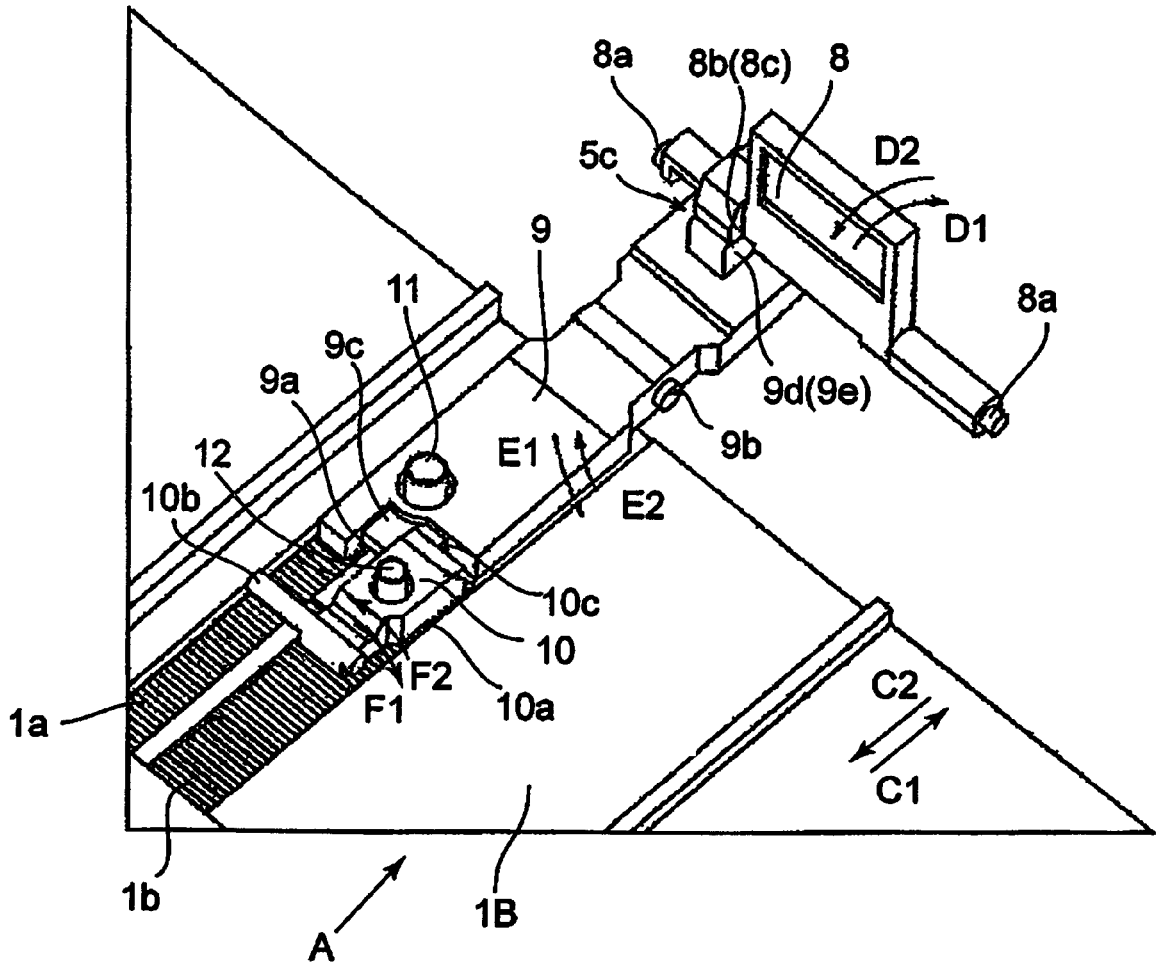
FIG. 4 is a perspective view which illustrates the configuration of an operation lever and an engage-disengage mechanism of a rear end restricting plate of the universal cassette.

As illustrated in FIG. 4, the first rack tooth row 1*a* and the second rack tooth row 1*b* are arranged at the bottom surface 1B of the cassette body 1A so as to be planar along the sheet feeding direction, namely, to be side by side (parallel) at the same height. Further, the first tooth row 9*a* of the first lock lever 9 and the second tooth row 10*a* of the second lock lever 10 are arranged to be parallel at the same height while the first tooth row 9*a* corresponds to the first rack tooth row 1*a* and the second tooth row 10*a* corresponds to the second rack tooth row 1*b*.

By engaging (mating) the first tooth row 9*a* and the second tooth row 10*a* respectively with the first rack tooth row 1*a* and the second rack tooth row 1*b*, the rear end restricting plate 5 is engaged with the cassette body 1A. Accordingly, the rear end restricting plate 5 is held at the restricting position in accordance with the sheet size.

In the present embodiment, by forming the first tooth row 9*a*, the second tooth row 10*a*, the first rack tooth row 1*a* and the second rack tooth row 1*b* with the triangular teeth, mechanically high holding strength can be ensured. As a result, the pitches of the first tooth row 9*a*, the second tooth row 10*a*, the first rack tooth row 1*a* and the second rack tooth row 1*b* can be formed small. Therefore, fine adjustment of the restricting position of the rear end restricting plate 5 can be performed.

Further, since the two tooth rows 9*a*, 10*a* are engaged respectively with the two rack tooth rows 1*a*, 1*b*, the pressing force to the rear end restricting plate 5 can be dispersed. Therefore, strong holding force of the rear end restricting plate 5 can be ensured.

Figure 5A:
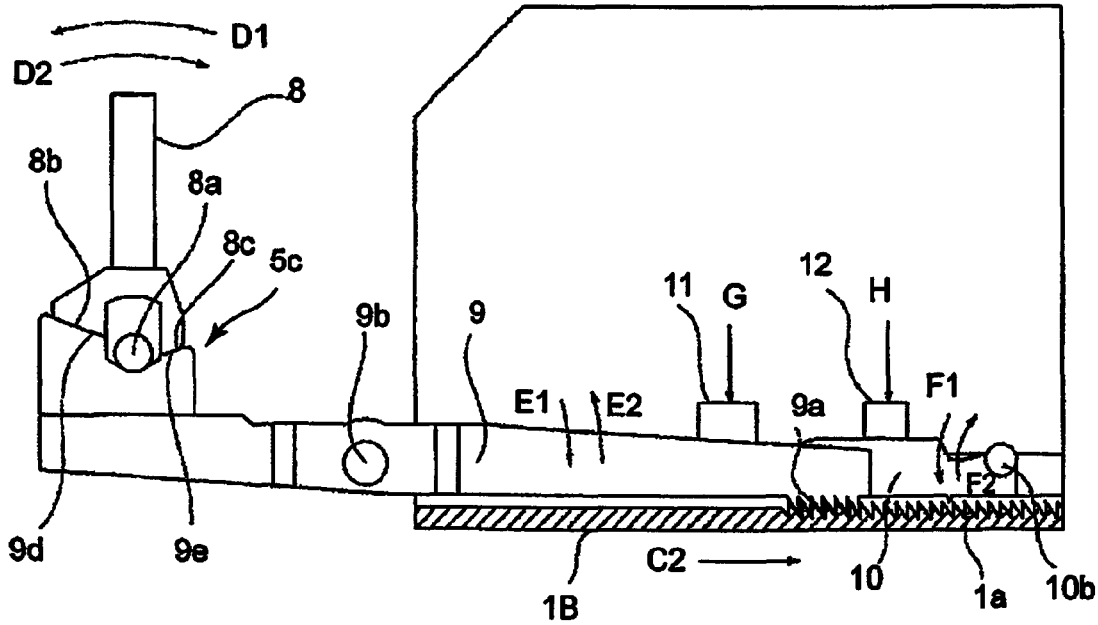
FIGS. 5A and 5B are sectional views which illustrates the configuration of the operation lever and the engage-disengage mechanism of the rear end restricting plate.

As illustrated in FIG. 5A, the teeth of the first tooth row 9*a* and the first rack tooth row 1*a* are shaped to have approximately vertical surfaces at the direction C2 side so that large resisting force (restricting force) is generated when the rear end restricting plate 5 is to be moved in direction C2 (the sheet restricting direction). Accordingly, when the rear end restricting plate 5 receives the force in direction C2, the approximately vertical surfaces of the first tooth row 9*a* and the first rack tooth row 1*a* are mutually pressed.

When the rear end restricting plate 5 receives the force in direction C2, the approximately vertical surfaces of the first tooth row 9*a* and the first rack tooth row 1*a* receive the force by being mutually pressed. Therefore, strong holding force of the rear end restricting plate 5 can be ensured.

Figure 5B:
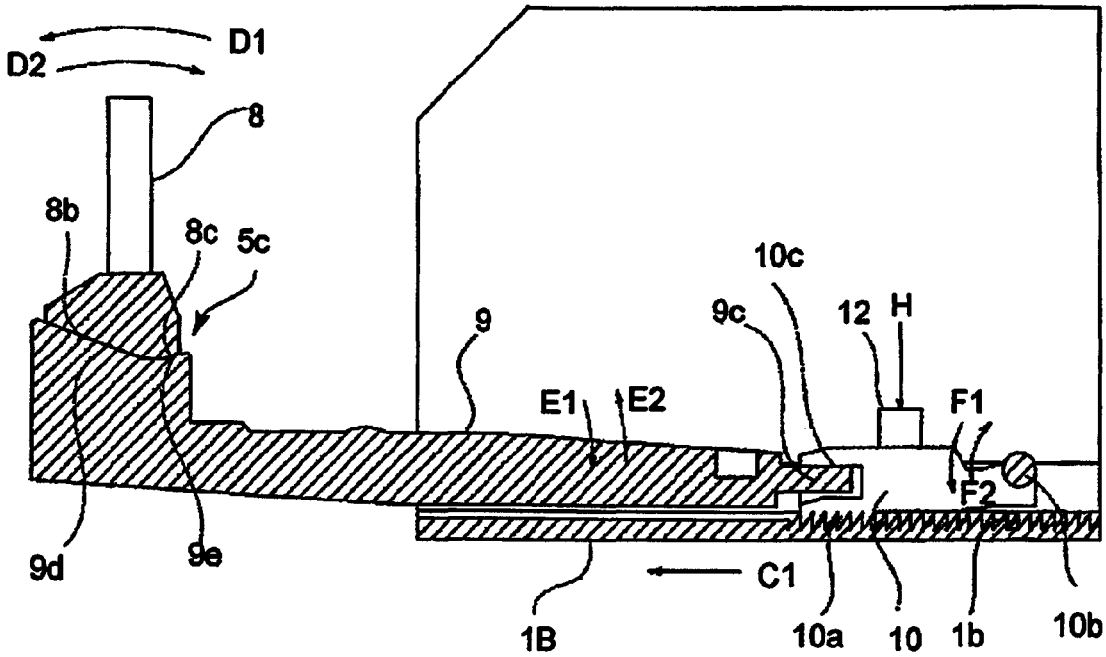

As illustrated in FIG. 5B, the teeth of the second tooth row 10*a* and the second rack tooth row 1*b* are shaped to have approximately vertical surfaces at the direction C1 side to be the opposite shape of the first tooth row 9*a* and the first rack tooth row 1*a*, namely, so that large resisting force is generated when the rear end restricting plate 5 is to be moved in direction C1. Accordingly, when the rear end restricting plate 5 receives the force in direction C1 (the direction opposite to the sheet restricting direction), the approximately vertical surfaces of the second tooth row 10*a* and the second rack tooth row 1*b* receive the force by being mutually pressed. Therefore, strong holding force of the rear end restricting plate 5 can be ensured.

Further, the first lock lever 9 is disposed at the slide portion 5*b* of the rear end restricting plate 5 in FIG. 3 to be free to swing (move) around a shaft 9*b* which is illustrated in FIGS. 4 and 5A in directions E1, E2 and urged toward the rack teeth with the moment in direction G by an elastic member 11. Furthermore, the second lock lever 10 is disposed at the slide portion 5*b* of the rear end restricting plate 5 to be free to turn in directions F1, F2 around a shaft 10*b* which is illustrated in FIGS. 4 and 5 and urged toward the rack teeth with the moment in direction H by an elastic member 12.

Here, as illustrated in FIG. 5B, a rib 9*c* is disposed at the end part of the first lock lever 9 at the second lock lever 10 side. An opening portion 10*c* is disposed at the end part of the second lock lever 10 at the first lock lever 9 side. Then, the rib 9*c* of the first lock lever 9 is inserted into the opening portion 10*c* of the second lock lever 10. Accordingly, the second lock lever 10 is turned in the vertical direction together with the vertical swinging of the first lock lever 9.

Namely, a linking portion which links the first lock lever 9 with the second lock lever 10 to turn the second lock lever 10 together with the swinging of the first lock lever 9 is configured with the rib 9*c* of the first lock lever 9 and the opening portion 10*c* of the second lock lever 10.

Further, two slant surfaces 9*d*, 9*e* which are formed to be V-shaped are arranged at the other end part of the first lock lever 9. The operation lever 8 which is illustrated in FIGS. 4 and 5A is arranged above the other end part of the first lock lever 9. Here, the operation lever 8 is arranged at the body portion 5*a* of the rear end restricting plate 5 in FIG. 3 to be free to turn around a shaft 8*a* which is illustrated in FIGS. 4 and 5A in directions D1, D2. Further, cam surfaces 8*b*, 8*c* which abut the slant surfaces 9*d*, 9*e* of the first lock lever 9 are arranged at the operation lever 8.

An engage-disengage mechanism 5*c* which releases the engagement between the rear end restricting plate 5 (the first lock lever 9 and the second lock lever 10) and the cassette body 1A in accordance with the operation of the operation lever 8 is configured with the cam surfaces 8*b*, 8*c* of the operation lever 8 and the slant surfaces 9*d*, 9*e* of the first lock lever 9. Namely, the engage-disengage mechanism 5*c* which is a transmitting portion to swing the first lock lever 9 by transmitting the turning operation of the operation lever 8 to the first lock lever 9 is configured with the cam surfaces 8*b*, 8*c* of the operation lever 8 and the slant surfaces 9*d*, 9*e* of the first lock lever 9.

Figure 6A:
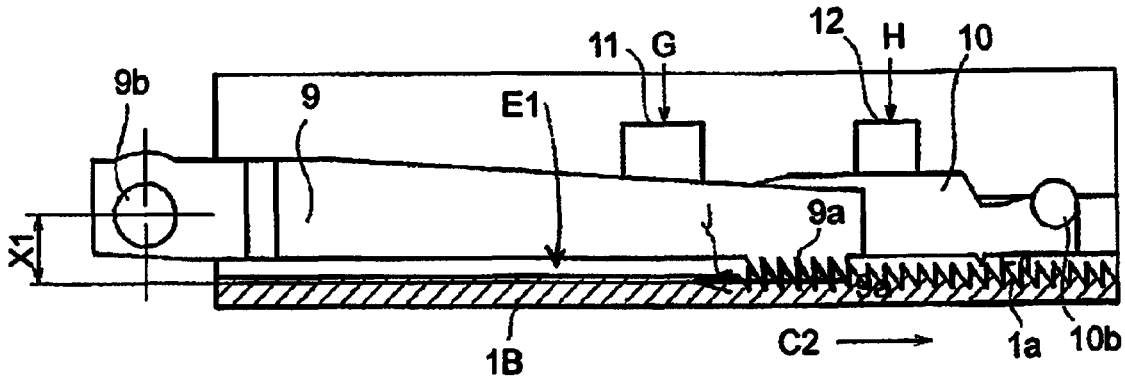
FIGS. 6A and 6B are sectional views which describes the force exerted on a first lock lever and a second lock lever of the rear end restricting plate.

As illustrated in FIG. 6A, when the rear end restricting plate 5 receives force in direction C2 due to the impact at the time of inserting the universal cassette or distributing, the force J is exerted to the first tooth row 9*a*. Here, when the shaft 9*b* is located below the operating line of the force J, the moment is generated at the first lock lever 9 in direction E2 in FIG. 5. Therefore, there is a possibility that the teeth of the first tooth row 9*a* departs from the teeth of the first rack tooth row 1*a* and that the rear end restricting plate 5 is shifted from the restricting position.

Here, in order to prevent the first lock lever 9 from departing from the teeth of the first rack tooth row 1*a*, the urging force G of the elastic member 11 may be enlarged. However, in this case, the operating force becomes large and the operability is decreased.

Therefore, in the present embodiment, the shaft 9*b* of the first lock lever 9 is located above the operating line of the force J by the distance X1. Accordingly, when the rear end restricting plate 5 receives force in direction C2, the moment in direction E1 is generated at the first lock lever 9 and the teeth of the first tooth row 9*a* are forced to bite into the teeth of the first rack tooth row 1*a*.

Figure 6B:
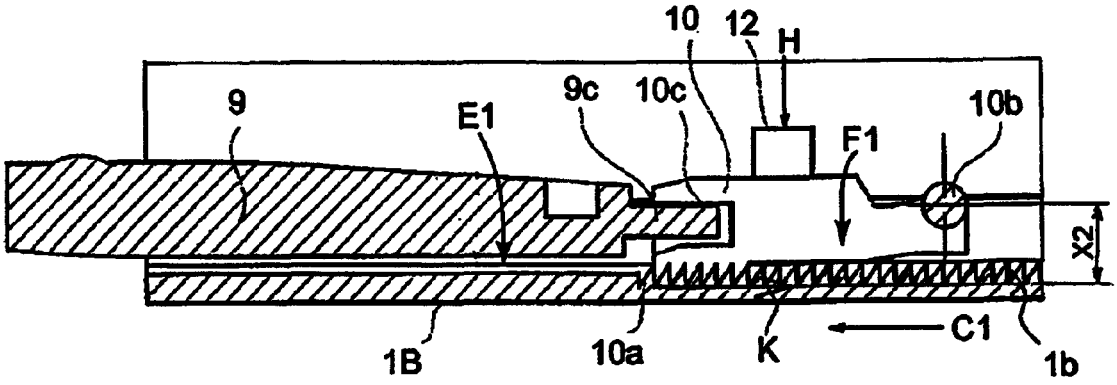

On the other hand, as illustrated in FIG. 6B, when the rear end restricting plate 5 receives force in direction C1, the force K is exerted to the second tooth row 10*a*. Here, when the shaft 10*b* is located below the operating line of the force K, the moment is generated at the second lock lever 10 in direction F2 in FIG. 5. Therefore, there is a possibility that the teeth of the second tooth row 10*a* departs from the teeth of the second rack tooth row 1*b* and that the rear end restricting plate 5 is shifted from the restricting position.

Therefore, in the present embodiment, the shaft 10*b* of the second lock lever 10 is located above the operating line of the force K by the distance X2. Accordingly, when the rear end restricting plate 5 receives force in direction C1, the moment in direction F1 is generated at the second lock lever 10 and the teeth of the second tooth row 10*a* are forced to bite into the teeth of the second rack tooth row 1*b*.

By locating the shaft 9*b* of the first lock lever 9 and the shaft 10*b* of the second lock lever 10 as described above, the first tooth row 9*a* and the second tooth row 10*a* are respectively forced to bite into the teeth of the first rack tooth row 1*a* and the second rack tooth row 1*b* when the rear end restricting plate 5 receives the force. Accordingly, the rear end restricting plate 5 can be reliably held at the restricting position with uniform and strong holding force.

Next, the movement operation of the rear end restricting plate 5 of such configuration is described.

In order to move the rear end restricting plate 5, first, the first lock lever 9 is swung around the shaft 9*b* in direction E2 departing from the first rack tooth row 1*a* by the turning operation of the operation lever 8 as described later. Accordingly, the opening portion 10*c* of the second lock lever 10 is pressed by the rib 9*c* of the first lock lever 9. Then, the second lock lever 10 is turned around the shaft 10*b* in direction F2 departing from the second rack tooth row 1*b*.

In this manner, when the second lock lever 10 is turned in direction F2 while the first lock lever 9 is swung in direction E2, the engagements of the first tooth row 9*a* and the second tooth row 10*a* respectively with the first rack tooth row 1*a* and the second rack tooth row 1*b* are simultaneously released. Then, after the rear end restricting plate 5 is moved to the restricting position in accordance with the sheet size, the first lock lever 9 and the second lock lever 10 are moved in the opposite direction by the turning operation of the operation lever 8 and the effect of the elastic members 11, 12.

Accordingly, the first tooth row 9*a* and the second tooth row 10*a* can be engaged with the first rack tooth row 1*a* and the second rack tooth row 1*b* and the rear end restricting plate 5 can be held at the restricting position in accordance with the sheet size. Here, the first lock lever 9 and the second lock lever 10 which engage the first tooth row 9*a* and the second tooth row 10*a* with the first rack tooth row 1*a* and the second rack tooth row 1*b* are held at the set position by being urged to the rack tooth row side with the elastic members 11, 12. By configuring the rear end restricting plate 5 to be held as described above, packaging can be downsized and distributing cost can be reduced.

As described above, the operation lever 8 is arranged to be free to turn around the shaft 8*a* in directions D1, D2. In addition, the two cam surfaces 8*b*, 8*c* which abut the two slant surfaces 9*d*, 9*e* of the first lock lever 9 are formed at the operation lever 8. Here, when the operation lever 8 is not operated, the cam surfaces 8*b*, 8*c* of the operation lever 8 does not influence the first lock lever 9.

Figure 7A:
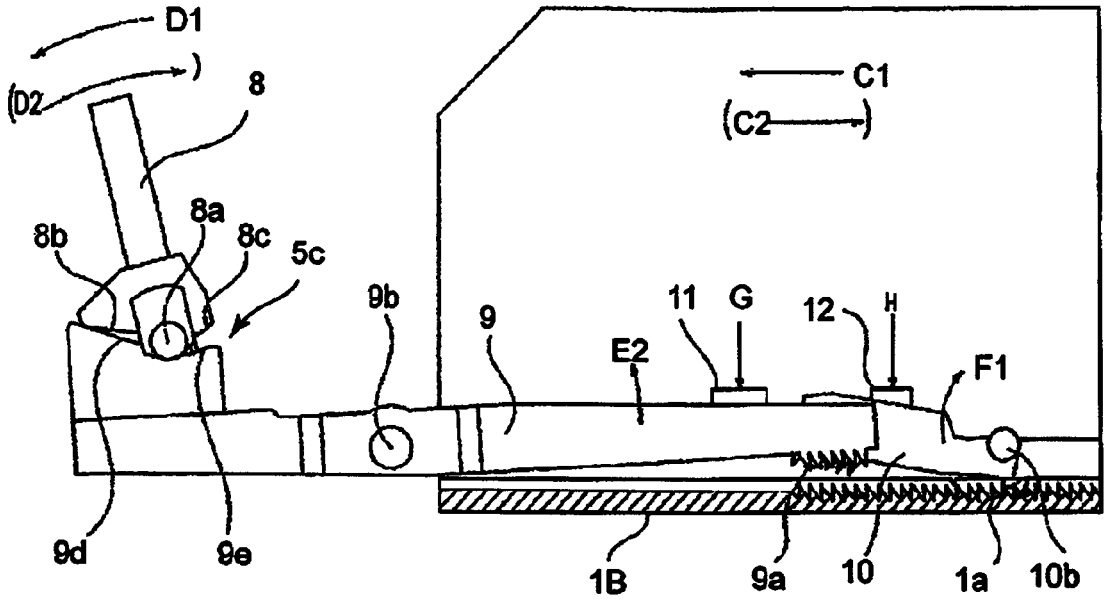
FIGS. 7A and 7B are sectional views which illustrates a state of the engage-disengage mechanism when the operation lever of the rear end restricting plate is turned.
Figure 7B:
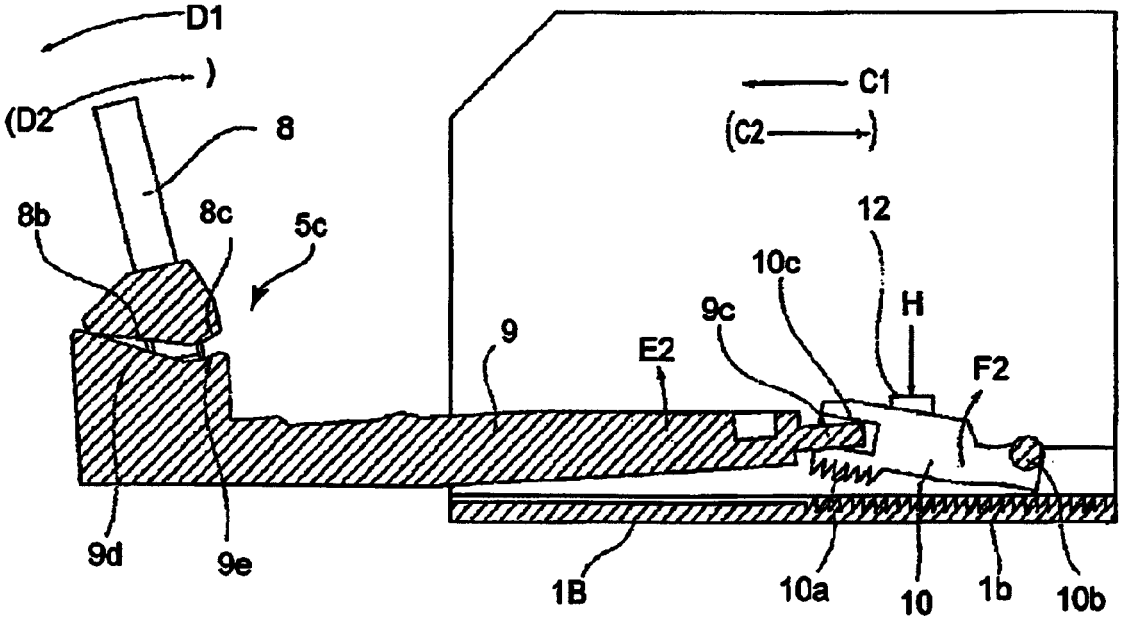

When the operation lever 8 is operated to turn around the shaft 8*a* in direction D1 as illustrated in FIGS. 7A and 7B, for example, the cam surface 8*b* of the operation lever 8 presses the slant surface 9*d* of the first lock lever 9. Accordingly, the first lock lever 9 is swung around the shaft 9*b* in direction E2 and the second lock lever 10 is also turned in direction F2 along with the operation of the first lock lever 9. Consequently, the engagements of the first tooth row 9*a* and the second tooth row 10*a* with the first rack tooth row 1*a* and the second rack tooth row 1*b* are released.

By releasing the engagements of the first tooth row 9*a* and the second tooth row 10*a* with the first rack tooth row 1*a* and the second rack tooth row 1*b*, the rear end restricting plate 5 can be moved in direction C1 thereafter to change the restricting position. Then, after the movement is completed, the operation lever 8 is turned to return to the original position and the first tooth row 9*a* and the second tooth row 10*a* are engaged with the first rack tooth row 1*a* and the second rack tooth row 1*b* due to the effect of the elastic members 11, 12. Consequently, the rear end restricting plate 5 can be held at the restricting position.

On the other hand, when the operation lever 8 is operated to turn in direction D2, the other cam surface 8*c* of the operation lever 8 presses the other slant surface 9*e* of the first lock lever 9. Similar to the case that the operation lever 8 is operated to turn in direction D1, the first lock lever 9 is swung in direction E2 and the second lock lever 10 is also turned in direction F2 along with the operation of the first lock lever 9. Consequently, the engagements of the first tooth row 9*a* and the second tooth row 10*a* with the first rack tooth row 1*a* and the second rack tooth row 1*b* are released so that the rear end restricting plate 5 can be moved. Therefore, the rear end restricting plate 5 can be moved in direction C2 thereafter to change the restricting position.

As described above, with the engage-disengage mechanism 5*c* of the present embodiment, in the case that the operation lever 8 is operated to turn in either direction, namely, regardless of the operating direction of the operation lever 8, the first lock lever 9 is moved in direction E2 and the second lock lever 10 is moved in direction F2. Accordingly, the engagements of the first tooth row 9*a* and the second tooth row 10*a* with the first rack tooth row 1*a* and the second rack tooth row 1*b* are released. Consequently, the rear end restricting plate 5 can be moved.

In other words, in order to move the rear end restricting plate 5, the engagement of the rear end restricting plate 5 with the cassette body 1A can be released simply with the turning operation of the operation lever 8. Accordingly, the hold releasing and moving of the rear end restricting plate 5 can be simultaneously performed by simply operating the operation lever 8 in the same direction as the movement direction of the rear end restricting plate 5. Consequently, the operability to move the rear end restricting plate 5 in accordance with the sheet size can be improved.

As described above, in the present embodiment, the first rack tooth row 1*a* and the second rack tooth row 1*b* are located at the bottom surface 1B of the cassette body 1A to be parallel along the sheet feeding direction. Further, the first tooth row 9*a* of the first lock lever 9 and the second tooth row 10*a* of the second lock lever 10 are also located to be parallel along the sheet feeding direction corresponding to the first rack tooth row 1*a* and the second rack tooth row 1*b*.

In this manner, by locating the first rack tooth row 1*a* and the second rack tooth row 1*b* at the bottom surface 1B of the cassette body 1A to be side by side (parallel) along the sheet feeding direction, the height of the cassette body 1A can be lowered. Further, by arranging the tooth rows 9*a*, 10*a* of the first lock lever 9 and the second lock lever 10 in accordance with the first rack tooth row 1*a* and the second rack tooth row 1*b*, the height of the rear end restricting plate 5 can be lowered. Accordingly, the universal cassette 1 can be downsized. Consequently, the rear end restricting plate 5 can be reliably held at the restricting position without upsizing the universal cassette 1.

Next, the second embodiment of the present invention is described.

Figure 8:
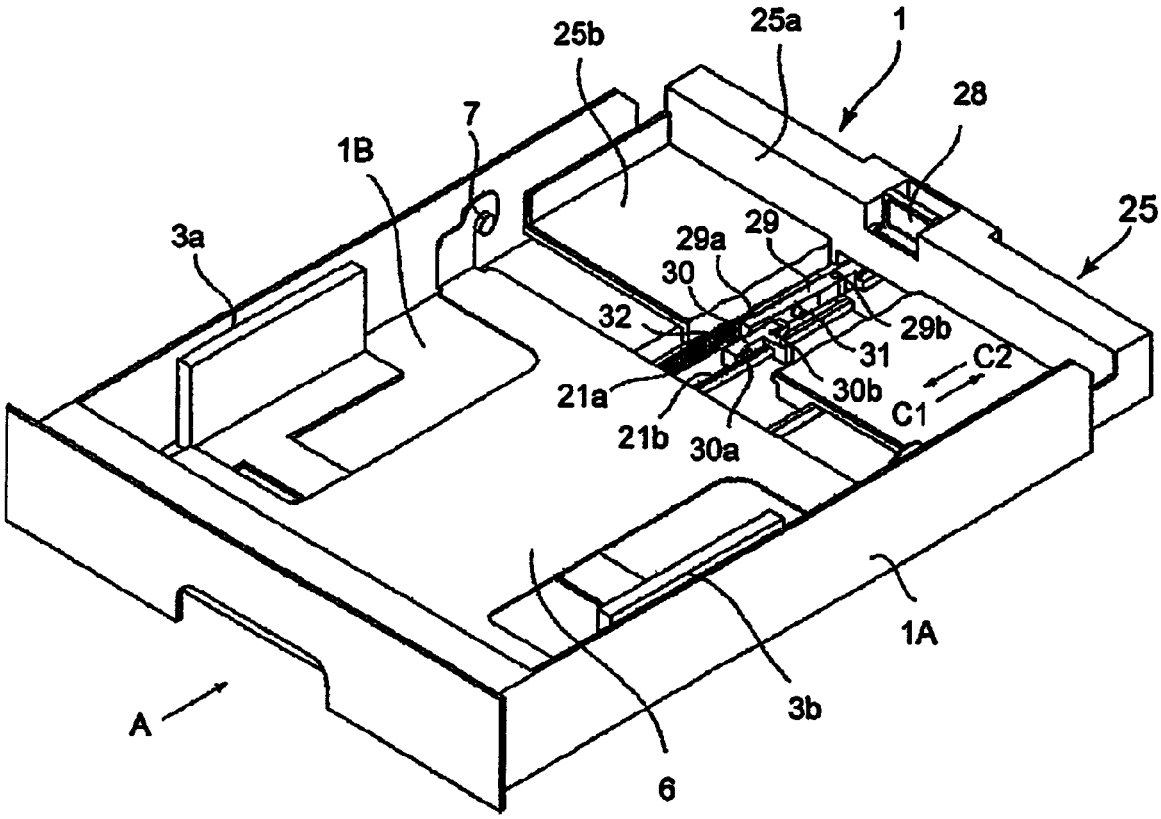
FIG. 8 is a perspective view which illustrates the configuration of a universal cassette arranged at a sheet feeding apparatus according to the second embodiment of the present invention.

FIG. 8 is a perspective view which illustrates the configuration of a universal cassette arranged at a sheet feeding apparatus according to the present embodiment. In FIG. 8, the same numeral is given to the same or similar part as in FIG. 3 which is described above.

As illustrated in FIG. 8, a rear end restricting plate 25 (also referred to herein as a "restricting member") is movable in the sheet feeding direction as being guided by a guide groove (not illustrated in the drawings) which is arranged in directions C1, C2 at the bottom surface 1B of the cassette body 1A.

Further, the rear end restricting plate 25 includes a body portion 25*a* which abuts the rear end of the sheets, a slide portion 25*b* to which the body portion 25*a* is arranged being perpendicular thereto, and an operation lever 28 which operates the rear end restricting plate 25. Furthermore, the rear end restricting plate 25 includes a first lock lever 29 as the first engaging member which holds the rear end restricting plate 25 at a predetermined restricting position being engaged with the bottom surface 1B of the cassette body 1A and a second lock lever 30 as the second engaging member which is arranged at the downstream side of the first lock lever 29 in the sheet feeding direction.

The first lock lever 29 has a first tooth row 29*a* which is configured with a plurality of triangular teeth at one side surface. The second lock lever 30 has a second tooth row 30*a* which is configured with a plurality of triangular teeth at a side surface being opposite to the side surface to which the first tooth row 29*a* of the first lock lever 29 is formed. The first tooth row 29*a* and the second tooth row 30*a* are arranged at the bottom surface 1B of the cassette body 1A so as to respectively correspond to a first rack tooth row 21*a* and a second rack tooth row 21*b* which are the first engaged portion and the second engaged portion configured with a plurality of triangular teeth.

Figure 9:
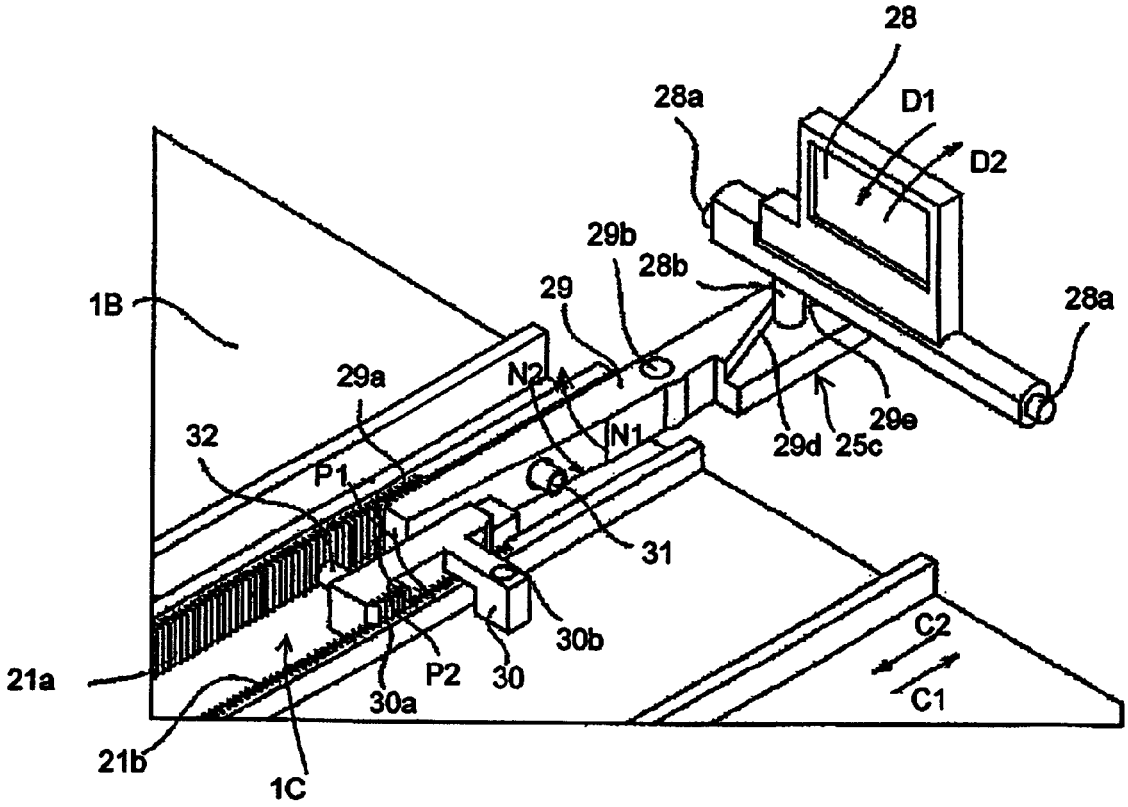
FIG. 9 is a perspective view which illustrates the configuration of an operation lever and an engage-disengage mechanism of a rear end restricting plate of the universal cassette.

As illustrated in FIG. 9, the first rack tooth row 21*a* and the second rack tooth row 21*b* are arranged to be mutually opposed at both opposed inner wall surfaces of a groove 1C which is formed along the sheet feeding direction at the bottom surface 1B of the cassette body 1A. Further, the first tooth row 29*a* of the first lock lever 29 is arranged corresponding to the first rack tooth row 21*a* and the second tooth row 30*a* of the second lock lever 30 are arranged corresponding to the second rack tooth row 21*b*.

By engaging (mating) the first tooth row 29*a* and the second tooth row 30*a* respectively with the first rack tooth row 21*a* and the second rack tooth row 21*b*, the rear end restricting plate 25 is engaged with the cassette body 1A. Accordingly, the rear end restricting plate 25 is held at the restricting position in accordance with the sheet size.

In the present embodiment, by forming the first tooth row 29*a*, the second tooth row 30*a*, the first rack tooth row 21*a* and the second rack tooth row 21*b* with the triangular teeth, mechanically high holding strength can be ensured. As a result, the pitches of the first tooth row 29*a*, the second tooth row 30*a*, the first rack tooth row 21*a* and the second rack tooth row 21*b* can be formed small. Therefore, fine adjustment of the restricting position of the rear end restricting plate 25 can be performed.

Figure 10:
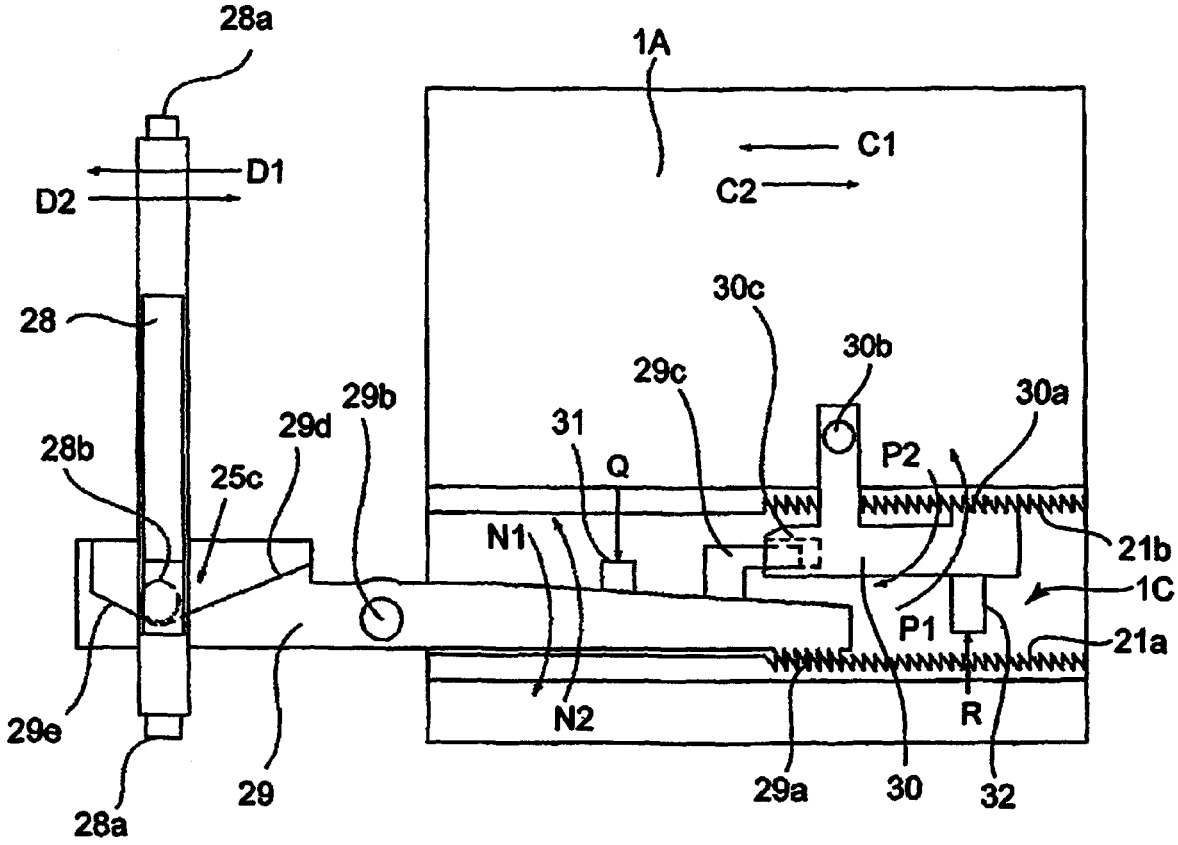
FIG. 10 is a plane view which illustrates the configuration of the operation lever and the engage-disengage mechanism of the rear end restricting mechanism.

As illustrated in FIG. 10, the teeth of the first tooth row 29*a* and the first rack tooth row 21*a* are shaped to have approximately vertical surfaces at the direction C2 side so that large resisting force is generated when the rear end restricting plate 25 is to be moved in direction C2 (the sheet restricting direction). Accordingly, when the rear end restricting plate 25 receives the force in direction C2, the approximately vertical surfaces of the first tooth row 29*a* and the first rack tooth row 21*a* are mutually pressed.

When the rear end restricting plate 25 receives the force in direction C2, the approximately vertical surfaces of the first tooth row 29*a* and the first rack tooth row 21*a* receive the force by being mutually pressed. Therefore, strong holding force of the rear end restricting plate 25 can be ensured.

On the other hand, the teeth of the second tooth row 30*a* and the second rack tooth row 21*b* are shaped to have approximately vertical surfaces at the direction C1 side to be the opposite shape of the first tooth row 29*a* and the first rack tooth row 21*a*, namely, so that large resisting force is generated when the rear end restricting plate 25 is to be moved in direction C1. Accordingly, when the rear end restricting plate 25 receives the force in direction C1, the approximately vertical surfaces of the second tooth row 30*a* and the second rack tooth row 21*b* receive the force by being mutually pressed. Therefore, strong holding force of the rear end restricting plate 25 can be ensured.

Here, the first lock lever 29 is disposed at the slide portion 25*b* of the rear end restricting plate 25 in FIG. 8 to be free to swing around a shaft 29*b* which is illustrated in FIGS. 9 and 10 in directions N1, N2 and urged toward the first rack tooth row 21*a* with the moment in direction Q by an elastic member 31. Furthermore, the second lock lever 30 is disposed at the slide portion 25*b* of the rear end restricting plate 25 to be free to turn in directions P1, P2 around a shaft 30*b* which is illustrated in FIGS. 9 and 10 and urged toward the second rack tooth row 21*b* with the moment in direction R by an elastic member 32.

Here, as illustrated in FIG. 10, a rib 29*c* is disposed at the end part of the first lock lever 29 at the second lock lever 30 side. An opening portion 30*c* is disposed at the end part of the second lock lever 30 at the first lock lever 29 side. Then, the rib 29*c* of the first lock lever 29 is inserted into the opening portion 30*c* of the second lock lever 30. Accordingly, the second lock lever 30 is turned in the horizontal direction together with the horizontal swinging of the first lock lever 29.

Namely, a linking portion which links the first lock lever 29 with the second lock lever 30 to turn the second lock lever 30 together with the swinging of the first lock lever 29 is configured with the rib 29*c* of the first lock lever 29 and the opening portion 30*c* of the second lock lever 30.

Further, two slant surfaces 29*d*, 29*e* which are formed to be V-shaped are arranged at the other end part of the first lock lever 29. The operation lever 28 is arranged above the other end part of the first lock lever 29. Here, the operation lever 28 is arranged at the body portion 25*a* of the rear end restricting plate 25 to be free to turn around a shaft 28*a* which is illustrated in FIGS. 9 and 10 in directions D1, D2. Further, a projection 28*b* which abuts the two slant surfaces 29*d*, 29*e* of the first lock lever 29 are arranged at the operation lever 28.

An engage-disengage mechanism 25*c* which releases the engagement between the rear end restricting plate 25 (the first lock lever 29 and the second lock lever 30) and the cassette body 1A in accordance with the operation of the operation lever 28 is configured with the projection 28*b* of the operation lever 28 and the slant surfaces 29*d*, 29*e* of the first lock lever 29. Namely, the engage-disengage mechanism 25*c* which is a transmitting portion to swing the first lock lever 29 by transmitting the turning operation of the operation lever 28 to the first lock lever 29 is configured with the projection 28*b* of the operation lever 28 and the slant surfaces 29*d*, 29*e* of the first lock lever 29.

Figure 11:
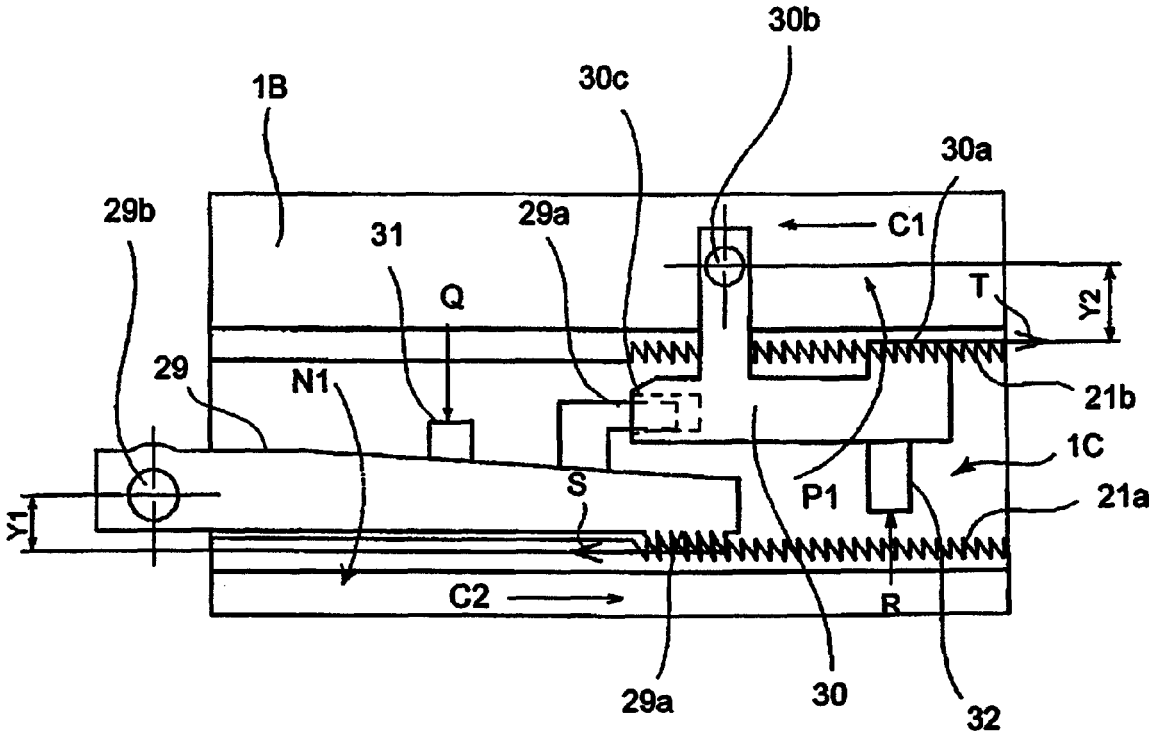
FIG. 11 is a plane view which describes the force exerted on a first lock lever and a second lock lever of the rear end restricting plate.

As illustrated in FIG. 11, when the rear end restricting plate 25 receives force in direction C2, the force S is exerted to the first tooth row 29*a*. Here, when the shaft 29*b* of the first lock lever 29 is located at a position being farther from the second rack tooth row 21*b* than the operating line of the force S, the moment is generated at the first lock lever 29 in direction N2 in FIG. 10. Then, the teeth of the first tooth row 29*a* depart from the teeth of the first rack tooth row 21*a*.

Therefore, in the present embodiment, the shaft 29*b* of the first lock lever 29 is located at the second rack tooth row 21*b* side of the operating line of the force S by the distance Y1. Accordingly, the moment in direction N1 is generated at the first lock lever 29 and the teeth of the first tooth row 29*a* are forced to bite into the teeth of the first rack tooth row 21*a*.

On the other hand, when the rear end restricting plate 25 receives force in direction C1, the force T is exerted to the second tooth row 30*a*. In this case, by also locating the shaft 30*b* of the second lock lever 30 at the first rack tooth row 21*a* side of the operating line of the force T by the distance Y2, the moment is generated at the second lock lever 30 in direction P1. Therefore, the teeth of the second tooth row 30*a* are forced to bite into the teeth of the second rack tooth row 21*b*.

By locating the shaft 29*b* of the first lock lever 29 and the shaft 30*b* of the second lock lever 30 as described above, the first tooth row 29*a* and the second tooth row 30*a* are respectively forced to bite into the teeth of the first rack tooth row 21*a* and the second rack tooth row 21*b* when the rear end restricting plate 25 receives the force. Accordingly, the rear end restricting plate 25 can be reliably held at the restricting position with uniform and strong holding force.

Next, the movement operation of the rear end restricting plate 25 of such configuration is described.

In order to move the rear end restricting plate 25, first, the first lock lever 29 is swung around the shaft 29*b* in direction N2 by operating the operation lever 28 as described later. Accordingly, the opening portion 30*c* of the second lock lever 30 is pressed by the rib 29*c* of the first lock lever 29. Then, the second lock lever 30 is turned around the shaft 30*b* in direction P2.

In this manner, when the second lock lever 30 is turned in direction P2 while the first lock lever 29 is swung in direction N2, the engagements of the first tooth row 29*a* and the second tooth row 30*a* respectively with the first rack tooth row 21*a* and the second rack tooth row 21*b* are simultaneously released. Then, after the rear end restricting plate 25 is moved to the restricting position in accordance with the sheet size, the first lock lever 29 and the second lock lever 30 are moved in the opposite direction by the operation of the operation lever 28 and the effect of the elastic members 31, 32.

Accordingly, the first tooth row 29*a* and the second tooth row 30*a* can be engaged with the first rack tooth row 21*a* and the second rack tooth row 21*b* and the rear end restricting plate 25 can be held at the restricting position in accordance with the sheet size. Here, the first lock lever 29 and the second lock lever 30 which engage the first tooth row 29*a* and the second tooth row 30*a* with the first rack tooth row 21*a* and the second rack tooth row 21*b* are held at the set position by being urged to the rack tooth row side with the elastic members 31, 32.

In the present embodiment, the operation lever 28 is arranged to be free to turn around the shaft 28*a* in directions D1, D2, as described above. In addition, the projection 28*b* which abuts the two slant surfaces 29*d*, 29*e* of the first lock lever 29 is formed at the operation lever 28. Here, when the operation lever 28 is not operated, the projection 28*b* of the operation lever 28 does not influence the first lock lever 29.

Figure 12:
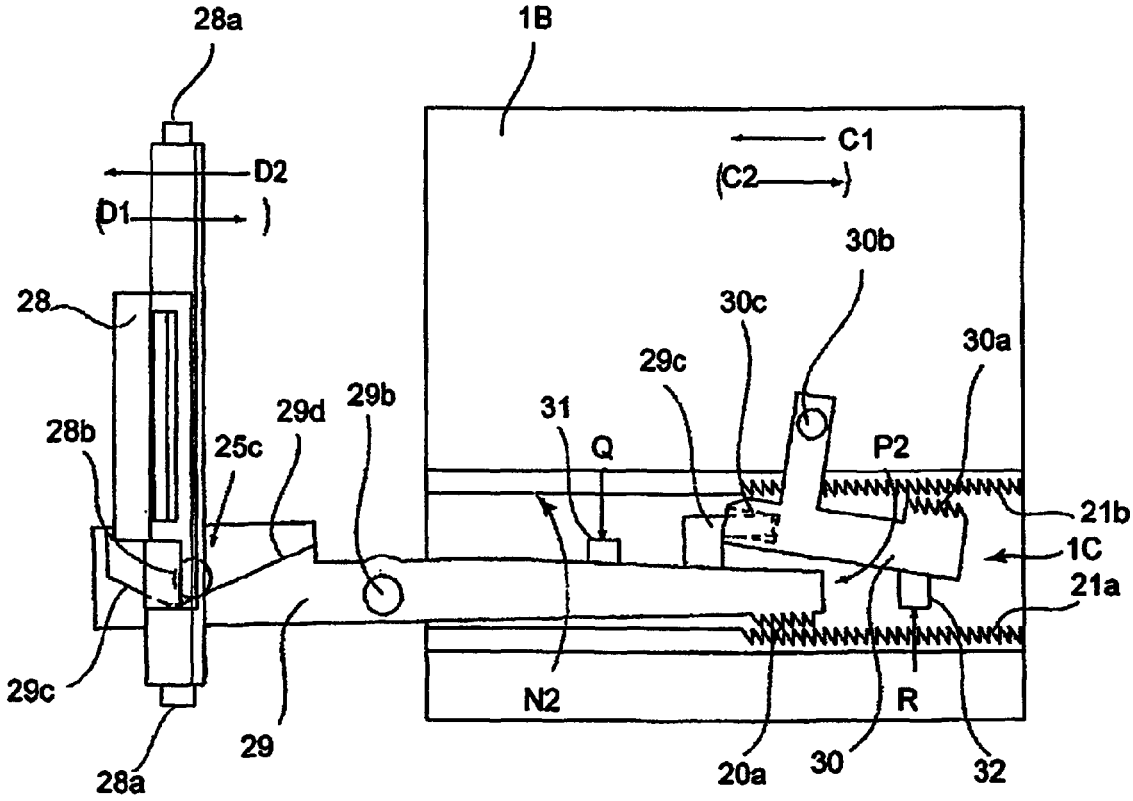
FIG. 12 is a plane view which illustrates a state of the engage-disengage mechanism when the operation lever of the rear end restricting plate is turned.

When the operation lever 28 is operated to turn around the shaft 28*a* in direction D1 as illustrated in FIGS. 9 and 12, for example, the projection 28*b* of the operation lever 28 presses the slant surface 29*d* of the first lock lever 29. Accordingly, the first lock lever 29 is swung around the shaft 29*b* in direction N2 and the second lock lever 30 is also turned in direction P2 along with the operation of the first lock lever 29. Consequently, the engagements of the first tooth row 29*a* and the second tooth row 30*a* with the first rack tooth row 21*a* and the second rack tooth row 21*b* are released.

By releasing the engagements of the first tooth row 29*a* and the second tooth row 30*a* with the first rack tooth row 21*a* and the second rack tooth row 21*b*, the rear end restricting plate 25 can be moved in direction C1 thereafter to change the restricting position. Then, after the movement is completed, the operation lever 28 is turned to return to the original position and the first tooth row 29*a* and the second tooth row 30*a* are engaged with the first rack tooth row 21*a* and the second rack tooth row 21*b* due to the effect of the elastic members 31, 32. Consequently, the rear end restricting plate 25 can be held at the restricting position.

On the other hand, when the operation lever 28 is operated to turn in direction D2, the projection 28*b* of the operation lever 28 presses the other slant surface 29*e* of the first lock lever 29. Similar to the case that the operation lever 28 is operated to turn in direction D1, the first lock lever 29 is turned in direction N2 and the second lock lever 30 is also turned in direction P2 along with the operation of the first lock lever 29. Consequently, the engagements of the first tooth row 29*a* and the second tooth row 30*a* with the first rack tooth row 21*a* and the second rack tooth row 21*b* are released so that the rear end restricting plate 25 can be moved. Therefore, the rear end restricting plate 25 can be moved in direction C2 thereafter to change the restricting position.

As described above, with the engage-disengage mechanism 25*c* of the present embodiment, in the case that the operation lever 28 is operated to turn in either direction, the first lock lever 29 is turned in direction N2 and the second lock lever 30 is turned in direction P2. Accordingly, the engagements of the first tooth row 29*a* and the second tooth row 30*a* with the first rack tooth row 21*a* and the second rack tooth row 21*b* are released. Consequently, the rear end restricting plate 25 can be moved.

In other words, in order to move the rear end restricting plate 25, the engagement of the rear end restricting plate 25 with the cassette body 1A can be released simply with the turning operation of the operation lever 28. Accordingly, the hold releasing and moving of the rear end restricting plate 25 can be simultaneously performed by simply operating the operation lever 28 in the same direction as the movement direction of the rear end restricting plate 25. Consequently, the operability to move the rear end restricting plate 25 in accordance with the sheet size can be improved.

As described above, in the present embodiment, the first rack tooth row 21*a* and the second rack tooth row 21*b* are located at the groove 1C formed at the bottom surface 1B of the cassette body 1A along the sheet feeding direction being mutually opposed in parallel. Further, the first tooth row 29*a* of the first lock lever 29 and the second tooth row 30*a* of the second lock lever 30 are located at respective one side surface of the first lock lever 29 and the second lock lever 30 along the sheet feeding direction in parallel corresponding to the first rack tooth row 21*a* and the second rack tooth row 21*b*.

In this manner, by locating the first rack tooth row 21*a* and the second rack tooth row 21*b* at the bottom surface 1B of the cassette body 1A to be parallel along the sheet feeding direction, the height of the cassette body 1A can be lowered. Further, by arranging the tooth rows 29*a*, 30*a* of the first lock lever 29 and the second lock lever 30 in accordance with the first rack tooth row 21*a* and the second rack tooth row 21*b*, the height of the rear end restricting plate 25 can be lowered. Consequently, the rear end restricting plate 25 can be reliably held at the restricting position without upsizing the universal cassette 1.

In the above, the holding mechanism of the rear end restricting plate is described. However, not limited to this, similar effects can be obtained with the present invention by configuring the holding mechanism of the width restricting plates 3*a*, 3*b* to be similar to the above.

While the present invention has been described with reference to exemplary embodiments, it is to be understood that the invention is not limited to the disclosed exemplary embodiments.

This application claims the benefit of Japanese Patent Application No. 2008-140491, filed May 29, 2008, which is hereby incorporated by reference herein in its entirety.

What is claimed is:

1. A sheet feeding apparatus which comprises a sheet cassette including a restricting member which is movably disposed at a cassette body for accommodating sheets and restricts a position of the sheets by being moved to a position in accordance with the sheets; the sheet cassette comprising:

a first engaged portion and a second engaged portion which are disposed at the cassette body;

a first engaging member which is disposed at the restricting member and which restricts a movement of the restricting member by being engaged with the first engaged portion when a force is exerted to the restricting member in one direction along a moving direction of the restricting member;

a second engaging member which is disposed at the restricting member and which restricts a movement of the restricting member by being engaged with the second engaged portion when a force is exerted to the restricting member in an opposite direction to the one direction;

an operation portion which is disposed at the restricting member and which is operated to release a restricting of the restricting member;

a transmitting portion which transmits the operation of the operation portion to the first engaging member and moves the first engaging member; and a linking portion which links the first engaging member with the second engaging member so as to move the second engaging member in accordance with the movement of the first engaging member, wherein the first engaged portion and the second engaged portion are arranged at the bottom surface of the cassette body to be the same height along the moving direction of the restricting member and the first engaging member and the second engaging member are arranged at the restricting member to be the same height along the moving direction, wherein the movement of the restricting member is restricted by engagements at the same time of both the engagement of the first engaged portion with the first engaging member and the engagement of the second engaged portion with the second engaging member, wherein when the restricting member is moved in the one direction or the opposite direction to the one direction, the operation of the operation portion toward the moving direction of the restricting member moves the first engaging member by the transmitting portion to release the engagement with the first engaged portion, and a movement of the first engaging member by the transmitting portion moves the second engaging member by the linking portion to release the engagement with the second engaged portion.

2. The sheet feeding apparatus according to claim 1, wherein the first engaged portion and the second engaged portion are disposed at the bottom surface of the cassette body so as to be planar, and the first engaging member and the second engaging member are disposed at the restricting member so as to be planar.

3. The sheet feeding apparatus according to claim 1, wherein the first engaged portion and the second engaged portion are respectively disposed at opposing side surfaces of a groove which is formed at the bottom surface of the cassette body along the sheet moving direction and the first engaging member and the second engaging member are disposed at the restricting member respectively opposing to the opposing side surfaces of the groove of the cassette body.

4. The sheet feeding apparatus according to claim 1, wherein the first engaging member is configured to be moved in the direction departing from the first engaged portion regardless of the operating direction of the operation portion when the operation of the operation portion is transmitted.

5. The sheet feeding apparatus according to claim 1, wherein the first engaged portion and the second engaged portion are engaged with the first engaging member and the second engaging member by mating tooth rows which are respectively disposed thereto, each of the tooth rows being configured with a plurality of teeth.

6. An image forming apparatus which comprises a sheet cassette including a restricting member which is movably disposed at a cassette body for accommodating sheets and restricts a position of the sheets by being moved to a position in accordance with the sheets; the sheet cassette comprising:

a first engaged portion and a second engaged portion which are disposed at the cassette body;

a first engaging member which is disposed at the restricting member and which restricts a movement of the restricting member by being engaged with the first engaged portion when a force is exerted to the restricting member in one direction along a moving direction of the restricting member;

a second engaging member which is disposed at the restricting member and which restricts a movement of the restricting member by being engaged with the second engaged portion when a force is exerted to the restricting member in an opposite direction to the one direction;

an operation portion which is disposed at the restricting member and which is operated to release a restricting of the restricting member;

a transmitting portion which transmits the operation of the operation portion to the first engaging member and moves the first engaging member; and a linking portion which links the first engaging member with the second engaging member so as to move the second engaging member in accordance with the movement of the first engaging member, wherein the first engaged portion and the second engaged portion are arranged at the bottom surface of the cassette body to be the same height along the moving direction of the restricting member and the first engaging member and the second engaging member are arranged at the restricting member to be the same height along the moving direction, wherein the movement of the restricting member is restricted by engagements at the same time of both the engagement of the first engaged portion with the first engaging member and the engagement of the second engaged portion with the second engaging member, wherein when the restricting member is moved in the one direction or the opposite direction to the one direction, the operation of the operation portion toward the moving direction of the restricting member moves the first engaging member by the transmitting portion to release the engagement with the first engaged portion, and a movement of the first engaging member by the transmitting portion moves the second engaging member by the linking portion to release the engagement with the second engaged portion.

7. The image forming apparatus according to claim 6, wherein the first engaged portion and the second engaged portion are disposed at the bottom surface of the cassette body so as to be planar, and the first engaging member and the second engaging member are disposed at the restricting member so as to be planar.

8. The image forming apparatus according to claim 6, wherein the first engaged portion and the second engaged portion are respectively disposed at opposing side surfaces of a groove which is formed at the bottom surface of the cassette body along the moving direction, and the first engaging member and the second engaging member are disposed at the restricting member respectively opposing to the opposing side surfaces of the groove of the cassette body.

9. The image forming apparatus according to claim 6, wherein the first engaging member is configured to be moved in the direction departing from the first engaged portion regardless of the operating direction of the operation portion when the operation of the operation portion is transmitted.

10. The image forming apparatus according to claim 6, wherein the first engaged portion and the second engaged portion are engaged with the first engaging member and the second engaging member by mating tooth rows which are respectively disposed thereto, each of the tooth rows being configured with a plurality of teeth.

* * * * *